US011225616B2

(12) United States Patent
Lee et al.

(10) Patent No.: US 11,225,616 B2
(45) Date of Patent: Jan. 18, 2022

(54) METHOD OF PRODUCING LUBRICATING BASE OIL FROM FEEDSTOCK COMPRISING DIESEL FRACTION, AND LUBRICATING BASE OIL PRODUCED THEREBY

(71) Applicants: SK INNOVATION CO., LTD, Seoul (KR); SK LUBRICANTS CO., LTD., Seoul (KR)

(72) Inventors: Seung Eon Lee, Daejeon (KR); Hak Mook Kim, Daejeon (KR); Jin Hee Ok, Daejeon (KR)

(73) Assignees: SK INNOVATION CO., LTD, Seoul (KR); SK LUBRICANTS CO., LTD., Seoul (KR)

( * ) Notice: Subject to any disclaimer, the term of this patent is extended or adjusted under 35 U.S.C. 154(b) by 0 days.

(21) Appl. No.: 16/920,900

(22) Filed: Jul. 6, 2020

(65) Prior Publication Data

US 2021/0087477 A1 Mar. 25, 2021

(30) Foreign Application Priority Data

Sep. 20, 2019 (KR) ..... 10-2019-0116062

(51) Int. Cl.
*C10G 45/64* (2006.01)
*C10G 65/12* (2006.01)
(Continued)

(52) U.S. Cl.
CPC ..... *C10G 45/64* (2013.01); *C10G 65/043* (2013.01); *C10G 65/12* (2013.01); *C10G 67/14* (2013.01);
(Continued)

(58) Field of Classification Search
CPC .. G01R 31/36; G01R 31/3646; G01R 31/382; G01R 31/3842; G01R 31/389;
(Continued)

(56) References Cited

U.S. PATENT DOCUMENTS 6,322,692 B1 * 11/2001 Cody ..... C10G 67/0445 208/18
6,432,297 B1 * 8/2002 Kalnes ..... C10G 65/00 208/58
(Continued)

FOREIGN PATENT DOCUMENTS

JP 2013534559 9/2013
KR 1020110111297 A 10/2011
(Continued)

OTHER PUBLICATIONS

M. V. Kitova, et al., "Catalytic Dewaxing of High-end-point Diesel Cuts," Chemistry and technology of fuels and oils, pp. 19-21 (Jan. 1, 2001).
(Continued)

*Primary Examiner* — Ellen M Mcavoy
*Assistant Examiner* — Chantel L Graham
(74) *Attorney, Agent, or Firm* — Abelman, Frayne & Schwab; Stefan Knirr

(57) ABSTRACT

Disclosed is a method of producing a lubricating base oil, including providing a feedstock including a diesel fraction, subjecting the feedstock to catalytic dewaxing, and recovering a lubricating base oil from a product of the catalytic dewaxing. A lubricating base oil produced thereby and a lubricant product including the lubricating base oil are also provided.

9 Claims, 2 Drawing Sheets

(51) Int. Cl.

| | |
|---|---|
| ***C10G 65/04*** | (2006.01) |
| ***C10G 67/14*** | (2006.01) |
| ***C10M 101/02*** | (2006.01) |
| ***C10M 177/00*** | (2006.01) |
| *C10N 20/02* | (2006.01) |
| *C10N 30/02* | (2006.01) |
| *C10N 30/08* | (2006.01) |
| *C10N 70/00* | (2006.01) |

(52) U.S. Cl.
CPC ..... *C10M 101/02* (2013.01); *C10M 177/00* (2013.01); *C10G 2300/302* (2013.01); *C10G 2300/304* (2013.01); *C10G 2300/308* (2013.01); *C10G 2400/10* (2013.01); *C10M 2203/1006* (2013.01); *C10N 2020/02* (2013.01); *C10N 2030/02* (2013.01); *C10N 2030/08* (2013.01); *C10N 2070/00* (2013.01)

(58) Field of Classification Search
CPC .. H01M 10/48; Y02E 60/10; C10G 2300/302; C10G 2300/304; C10G 2300/308; C10G 2400/10; C10G 45/58; C10G 45/64; C10G 65/043; C10G 65/12; C10G 67/14; C10M 101/02; C10M 171/02; C10M 177/00; C10M 2203/1006; C10M 2203/1025; C10N 2020/011; C10N 2020/015; C10N 2020/017; C10N 2020/02; C10N 2030/02; C10N 2030/08; C10N 2030/62; C10N 2030/74; C10N 2040/08; C10N 2040/16; C10N 2060/02; C10N 2070/00
See application file for complete search history.

(56) References Cited

U.S. PATENT DOCUMENTS

| | | | | |
|---|---|---|---|---|
| 9,988,585 | B2 | 6/2018 | Hayakasa et al. | |
| 2010/0181229 | A1* | 7/2010 | Hayasaka ..... | C10G 45/62 208/28 |

FOREIGN PATENT DOCUMENTS

| | | | |
|---|---|---|---|
| KR | 2012-0040150 | A | 4/2012 |
| KR | 102012-0104366 | A | 9/2012 |
| KR | 1020140122001 | A | 10/2014 |
| KR | 101595350 | B1 | 2/2016 |
| KR | 101654412 | B | 8/2016 |
| KR | 101679426 | B1 | 11/2016 |
| KR | 20170001062 | A | 1/2017 |
| WO | 02038702 | A1 | 5/2002 |
| WO | 2020067690 | A1 | 4/2020 |

OTHER PUBLICATIONS

European Search Report from corresponding EP Application No. EP 20 18 4967 dated Nov. 24, 2020.
Office Action from corresponding Korean Application No. 2020-065778562 dated Sep. 23, 2020 (Office Action and English Translation).

* cited by examiner

METHOD OF PRODUCING LUBRICATING BASE OIL FROM FEEDSTOCK COMPRISING DIESEL FRACTION, AND LUBRICATING BASE OIL PRODUCED THEREBY

CROSS-REFERENCE TO RELATED APPLICATION

This application claims the benefit of Korean Patent Application No. 10-2019-0116062, filed Sep. 20, 2019, entitled "A method for producing lubricating base oil from feedstock comprising diesel fraction, and lubricating base oil produced thereby", which is hereby incorporated by reference in its entirety into this application.

BACKGROUND OF THE DISCLOSURE

1. Technical Field

The present disclosure relates to a method of producing a lubricating base oil from a feedstock including a diesel fraction and a lubricating base oil produced thereby, and more particularly to a method of producing a mineral oil-based lubricating base oil imparted with improved low-temperature performance at ultra-low viscosity from a feedstock including a diesel fraction and a lubricating base oil produced thereby.

2. Description of the Related Art

Lubricating base oil is a material for lubricant products. Generally, excellent lubricating base oil has a high viscosity index, superior stability (to oxidation, heat, UV, etc.) and low volatility. The American Petroleum Institute (API) classifies lubricating base oils depending on the quality thereof as shown in Table 1 below.

TABLE 1

| Classification | Sulfur (%) | Saturate (%) | VI (Viscosity Index) |
|---|---|---|---|
| Group I | >0.03 | <90 | 80 to 120 |
| Group II | ≤0.03 | ≥90 | 80 to 120 |
| Group III | ≤0.03 | ≥90 | 120 or more |
| Group IV | All polyalphaolefins (PAOs) | | |
| Group V | All other lubricating base oils not included in Group I, II, III, or IV | | |

In general, among mineral oil-based lubricating base oils, lubricating base oils manufactured through a solvent extraction process mainly correspond to Group I, lubricating base oils manufactured through a hydroreforming process mostly correspond to Group II, and lubricating base oils having a high viscosity index manufactured through an advanced hydrocracking process mainly correspond to Group III. Meanwhile, there is a need for lubricant products that are useful in harsh temperatures, such as during cold weather or in polar regions. Accordingly, many attempts have been made to improve the low-temperature properties of lubricant products by introducing additives such as a pour point depressant, a viscosity modifier and the like to conventional lubricating base oil. However, excess additive content may impair the performance of the lubricant product itself, and thus, the addition thereof faces limitations. Hence, a lubricating base oil, the intrinsic low-temperature performance of which is improved, is required.

This lubricating base oil is required to have a low viscosity and a low pour point. Suitable lubricating base oils include polyalphaolefins (PAOs) and ester base oils, among synthetic base oils. PAOs have superior viscosity stability and low-temperature fluidity, and ester base oils also have superior viscosity stability. However, PAOs and ester base oils have the disadvantage of being expensive in terms of cost.

Therefore, efforts to produce a mineral oil-based lubricating base oil that has low-temperature performance equivalent or superior to those of synthetic base oils and is competitive in price with synthetic base oils have continued. Among these, the process of producing a lubricating base oil feedstock in connection with conventional fuel-oil hydrocracking (HC) uses unconverted oil (UCO), generated by hydrocracking vacuum gas oil produced in a vacuum distillation unit. Here, the oil fraction is subjected to a hydrotreating process that removes impurities such as sulfur, nitrogen, oxygen and metal components therefrom and then to a hydrocracking process, which is the main reaction process, whereby a considerable amount thereof is converted into light hydrocarbons, which are then subjected to a series of fractional distillation processes to separate a variety of decomposed oils and gases, thereby obtaining light oil products. The above reaction is designed such that the reaction conversion rate per pass is typically about 40%, and it is impossible in practice to realize 100% conversion per pass. In the last fractional distillation process, unconverted oil (UCO) is always generated, and a portion thereof is used as a feed for lubricating base oil, and the remainder thereof is recycled to the hydrocracking process. However, in the lubricating base oil derived from the unconverted oil, mineral oil-based lubricating base oil having low-temperature performance equivalent or superior to those of synthetic base oils, without the addition of additional additives, has not been known to date.

As described above, there remains a need for a novel mineral oil-based lubricating base oil having price competitiveness with synthetic base oils and low-temperature performance equivalent or superior thereto.

CITATION LIST

Patent Literature (Patent Document 1) KR10-1679426 B2

SUMMARY OF THE DISCLOSURE

Accordingly, a first aspect of the present disclosure is to provide a method of producing a lubricating base oil having improved low-temperature performance capable of replacing the expensive synthetic base oil as described above.

A second aspect of the present disclosure is to provide a lubricating base oil produced using the method according to the first aspect.

Therefore, an embodiment of the present disclosure for accomplishing the first aspect provides a method of producing a lubricating base oil, including providing a feedstock including a diesel fraction, subjecting the feedstock to catalytic dewaxing, and recovering a lubricating base oil from the product of the catalytic dewaxing.

In an exemplary embodiment of the present disclosure, the feedstock may have a 10% outflow temperature of 250° C. or less and a 50% outflow temperature of 350° C. or less in a simulated distillation test according to ASTM D2887.

In an exemplary embodiment of the present disclosure, the feedstock may have specific gravity of 0.81 to 0.87, kinematic viscosity at 40° C. of 5.0 cSt or less, kinematic viscosity at 100° C. of 2.0 cSt or less, and a pour point of 5° C. or less, and may contain 2.0 wt % or less of each of sulfur and nitrogen.

In an exemplary embodiment of the present disclosure, the average carbon number of a hydrocarbon molecule in the feedstock may be 10 to 25.

In an exemplary embodiment of the present disclosure, the feedstock may include 90 wt % or more of the diesel fraction.

In an exemplary embodiment of the present disclosure, the feedstock may further include a fuel oil fraction that is lighter than the diesel fraction.

In an exemplary embodiment of the present disclosure, the fuel oil fraction that is lighter than the diesel fraction may be a kerosene fraction.

In an exemplary embodiment of the present disclosure, the feedstock may include unconverted oil in an amount less than 5 wt %.

In an exemplary embodiment of the present disclosure, the catalytic dewaxing may be performed at a reaction temperature of 250 to 410° C., a reaction pressure of 30 to 200 $kg/cm^2$, a liquid hourly space velocity (LHSV) of 0.1 to 3.0 $hr^{-1}$, and a hydrogen-to-feedstock volume ratio of 150 to 1000 $Nm^3/m^3$.

Another embodiment of the present disclosure for accomplishing the second aspect provides a lubricating base oil produced by the method according to the first aspect of the present disclosure, in which the lubricating base oil has kinematic viscosity at 40° C. of 9.0 cSt or less, kinematic viscosity at 100° C. of 2.5 cSt or less, and a pour point of −50° C. or less.

According to the present disclosure, the lubricating base oil has a low viscosity and pour point compared to conventional low-viscosity lubricating base oil, and thus exhibits improved low-temperature performance. The lubricating base oil can be applied to lubricant products having high performance at ultra-low viscosity or to lubricant products used in extremely cold regions, in which low-temperature performance is considered important. Moreover, it is possible to manufacture a lubricant product that satisfies the required performance through appropriate mixing with conventional mineral oil-based lubricating base oil.

The conventional method of manufacturing lubricant products is capable of satisfying the required performance using expensive synthetic base oil such as PAO or ester base oil, but it is possible to replace the synthetic base oil with the lubricating base oil according to the present disclosure, thus generating economic benefits.

In addition, when producing a lubricating base oil having low viscosity through a conventional method of producing a lubricating base oil using unconverted oil, a lubricating base oil having low viscosity as desired has to be recovered through additional separation and purification processes, and thus additional processing and the inevitable production of lubricating base oils having undesired properties are involved. However, when using the production method of the present disclosure, there is an advantage that it is possible to selectively produce only the lubricating base oil having low viscosity, as desired.

DESCRIPTION OF SPECIFIC EMBODIMENTS

Figure 1:
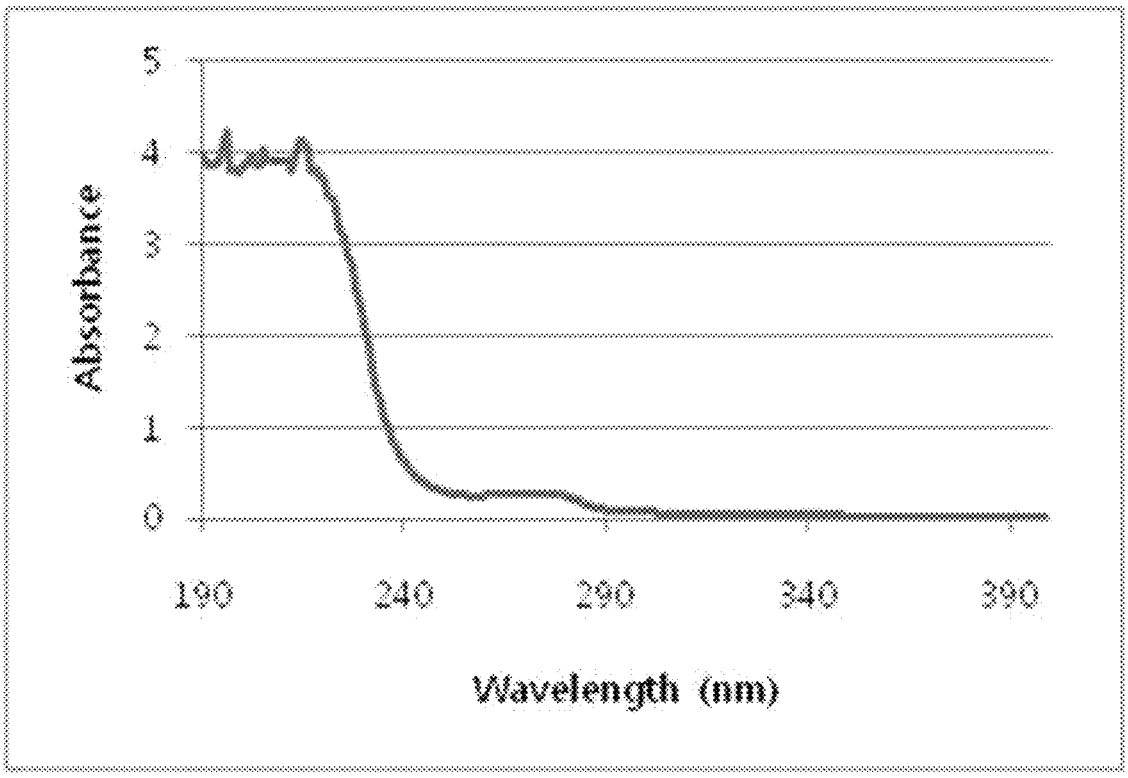
FIG. 1 is a plot of the results of measurement of UV absorbance of the lubricating base oil according to an embodiment of the present disclosure.

The objectives, specific advantages and novel features of the present disclosure will become more apparent from the following detailed description and preferred embodiments associated with the accompanying drawings, but the present disclosure is not necessarily limited thereto. Furthermore, in the description of the present disclosure, it is to be noted that, when known techniques related to the present disclosure may make the gist of the present disclosure unclear, a detailed description thereof will be omitted.

As used herein, the term "unconverted oil (UCO)" means unreacted oil that has been fed to a hydrocracking unit for manufacturing fuel oil but has not undergone a hydrocracking reaction.

As used herein, the terms "fuel oil fraction", "gasoline fraction", "naphtha fraction", "kerosene fraction", and "diesel fraction" are fractions obtained from petroleum, and indicate fractions available as fuel oil, gasoline, naphtha, kerosene, and diesel, respectively, through subsequent processes (e.g. catalytic dewaxing, hydrofinishing, and the like).

Method of Producing Lubricating Base Oil

Hereinafter, the production method of the present disclosure will be described in more detail.

In a conventional process of producing a lubricating base oil, it is common to produce a lubricating base oil from unconverted oil (UCO) of a fuel-oil hydrogenation process using vacuum gas oil (VGO). Specifically, vacuum gas oil (VGO) separated from a vacuum distillation (V) unit is fed to a hydrotreating (HDT) unit to remove impurities such as sulfur, nitrogen, oxygen and metal components, followed by a hydrocracking (HDC) process to produce a light oil fraction, and also unconverted oil (UCO) produced thereby is fed to a catalytic dewaxing (CDW) unit to afford a lubricating base oil.

The production method of the present disclosure provides a method of producing a lubricating base oil using a diesel fraction, unlike a conventional method of producing a lubricating base oil using unconverted oil (UCO). The method of producing a lubricating base oil according to the present disclosure includes providing a feedstock including a diesel fraction, subjecting the feedstock to catalytic dewaxing, and recovering a lubricating base oil from the product of the catalytic dewaxing.

In an embodiment of the present disclosure to produce a lubricating base oil from a diesel fraction obtained by a fuel-oil hydrogenation process using vacuum gas oil (VGO), atmospheric residue (AR), separated from a crude distillation unit (CDU), is distilled in a vacuum distillation (V) unit and separated into vacuum gas oil (VGO) and vacuum residue (VR), and the vacuum gas oil (VGO) is sequentially fed to a hydrotreating (HDT) unit and a hydrocracking (HDC) unit. The vacuum gas oil (VGO) passed through the hydrocracking (HDC) unit is then fed to fractionators (Fs), whereby unconverted oil (UCO), a diesel fraction, and a fuel oil fraction that is lighter than the diesel fraction are separated through the fractionators (Fs). The diesel fraction is fed to a catalytic dewaxing (CDW) unit, and the lubricating base oil of the present disclosure is recovered from the product of the catalytic dewaxing.

Hydrotreating (HDT) is a process for removing impurities such as sulfur, nitrogen, oxygen, and metal components contained in petroleum fractions, such as vacuum gas oil (VGO). After the hydrotreating (HDT) process, the petroleum fractions are converted into light hydrocarbons through hydrocracking in a hydrocracking (HDC) unit. The hydrotreating (HDT) and hydrocracking (HDC) processes may be performed under any conventional processing conditions, so long as they do not interfere with acquisition of the diesel fraction used in the present disclosure.

Light and heavy hydrocarbons produced through hydrocracking (HDC) are fed to fractionators (Fs), and are thus separated into unconverted oil (UCO), a diesel fraction, and a fuel oil fraction that is lighter than the diesel fraction, which are used in the production of fuel oil products lighter than diesel oil (LPG, gasoline, jet fuel oil, etc.). The unconverted oil (UCO) may be fed to a conventional lubricating base oil production unit or may be recycled and fed again to the hydrocracking (HDC) unit.

In the present disclosure, the diesel fraction contained in the feedstock used to produce the lubricating base oil is not limited to those obtained through the above-described processes, and it should be noted that it is possible to use, as the feedstock, a diesel fraction obtained through any of various routes, such as fractional distillation of crude oil, further decomposition of unconverted oil (UCO), or separation purification.

In an embodiment of the present disclosure, the feedstock including the diesel fraction has a 10% outflow temperature of 250° C. or less and a 50% outflow temperature of 350° C. or less in a simulated distillation test according to ASTM D2887, preferably a 10% outflow temperature of 240° C. or less and a 50% outflow temperature of 340° C. or less, and more preferably a 10% outflow temperature of 230° C. or less and a 50% outflow temperature of 330° C. or less. In another embodiment of the present disclosure, the feedstock has an 80% outflow temperature of 400° C. or less, preferably 370° C. or less, and more preferably 350° C. or less, in a simulated distillation test according to ASTM D2887. In still another embodiment of the present disclosure, the feedstock has a 90% outflow temperature of 400° C. or less, preferably 370° C. or less, and more preferably 360° C. or less, in a simulated distillation test according to ASTM D2887. ASTM D2887 is a method of analyzing the boiling point of a sample through a simulated gas chromatography distillation test, in which, when the temperature of the feedstock is gradually increased, the hydrocarbon component in the feedstock is eluted through a capillary column, and the boiling point distribution may be determined through comparison with a reference material measured under the same conditions. When the outflow temperature falls out of the corresponding range, the kinematic viscosity and low-temperature viscosity of the resulting base oil product may increase, which may adversely affect lubricant performance.

Table 2 below shows the results of the simulated distillation test according to ASTM D2887 on the feedstock according to an embodiment of the present disclosure.

TABLE 2

| Classification | | Method | Feedstock of the present disclosure | UCO |
|---|---|---|---|---|
| Distillation (GC-SimDis) | IBP | D2887 | 151.0 | 298.8 |
| | 5% | | 202.5 | 354.1 |
| | 10% | | 228.5 | 373.5 |
| | 20% | | 260.0 | 395.8 |
| | 30% | | 278.5 | 410.9 |

TABLE 2-continued

| Classification | | Method | Feedstock of the present disclosure | UCO |
|---|---|---|---|---|
| | 40% | | 292.5 | 424.1 |
| | 50% | | 304.0 | 437 |
| | 60% | | 315.5 | 450.6 |
| | 70% | | 328.5 | 466.3 |
| | 80% | | 343.0 | 485.6 |
| | 90% | | 358.5 | 513.6 |
| | 95% | | 367.5 | 536.8 |
| | FBP | | 386.0 | 583.4 |

Also, the feedstock may have a specific gravity of 0.81 to 0.87, and preferably 0.82 to 0.86. Although the specific gravity does not directly affect the performance of the lubricating base oil, it is helpful for determining whether foreign matter is mixed in the diesel fraction.

Also, the feedstock may have kinematic viscosity at 40° C. of 5.0 cSt or less, preferably 4.7 cSt or less, and more preferably 4.5 cSt or less, and kinematic viscosity at 100° C. of 2.0 cSt or less, preferably 1.8 cSt or less, and more preferably 1.6 cSt or less. The kinematic viscosity is a value obtained by dividing the viscosity of a fluid by the density of the fluid. In general, "viscosity" of the lubricating base oil refers to kinematic viscosity, and the measurement temperatures are set to 40° C. and 100° C. according to the viscosity classification based on the International Organization for Standardization (ISO).

Also, the feedstock may have a pour point of 5° C. or less, preferably −5° C. or less, more preferably −10° C. or less, and most preferably −15° C. or less. When the oil is cooled, the viscosity gradually increases, losing fluidity and starting to harden. The temperature at this time is called the solidification point, and the pour point is the lowest temperature at which fluidity is observed before reaching the solidification point. "Pour point" usually refers to a temperature 2.5° C. higher than the solidification point.

Also, the feedstock may contain 2.0 wt % or less of each of sulfur and nitrogen, and preferably, the feedstock contains 1.0 wt % or less of each of sulfur and nitrogen. Sulfur and nitrogen, even when present in trace amounts, may adversely affect the catalyst in subsequent processes and the stability of the final product, and are typically removed through the hydrotreating (HDT) process as described above.

As mentioned above, the feedstock of the present disclosure includes a diesel fraction. Accordingly, the feedstock may have an average carbon number of 10 to 25, preferably 10 to 22, and more preferably 10 to 20 per hydrocarbon molecule. If the average number of carbon atoms is less than 10, a problem may occur in which the flash point and evaporation loss are too low. On the other hand, if the average number of carbon atoms exceeds 25, low-temperature performance (low-temperature viscosity and pour point) becomes too high, which may cause a problem in that it is difficult to satisfy the performance requirements of the lubricant itself.

According to an embodiment of the present disclosure, the feedstock may include a diesel fraction in an amount of 90% or more, and preferably 95% or more. Most preferably, the feedstock may be composed of 100% of the diesel fraction. If the amount of the diesel fraction in the feedstock is less than 90%, it is difficult to obtain a lubricating base oil imparted with improved low-temperature performance according to the present disclosure.

According to an embodiment of the present disclosure, the feedstock may further include a fuel oil fraction that is lighter than the diesel fraction. Here, the fuel oil fraction that is lighter than the diesel fraction may be a gasoline fraction, a naphtha fraction, a kerosene fraction, or the like. From the viewpoint of volatility, the fuel oil fraction that is lighter than the diesel fraction is preferably a kerosene fraction. When the kerosene fraction is included, the viscosity of the final lubricating base oil may be lowered, which may be advantageous in view of low-temperature performance and compatibility with additives.

According to an embodiment of the present disclosure, the feedstock may include unconverted oil in an amount less than 5 wt %, and preferably less than 1 wt %. Most preferably, the feedstock does not contain unconverted oil. As described above, the lubricating base oil of the present disclosure is produced from the diesel fraction, and the presence of the unconverted oil in the feedstock may be regarded as an impurity. If the amount of the unconverted oil in the feedstock exceeds 5 wt %, there is the possibility of negatively affecting the viscosity and pour point of the final lubricating base oil.

According to an embodiment of the present disclosure, the feedstock may be fed to a catalytic dewaxing (CDW) unit before or after obtaining the same. Preferably, the feedstock is fed to a catalytic dewaxing (CDW) unit after obtaining the same. Here, catalytic dewaxing (CDW) is a process of reducing or removing N-paraffin, which deteriorates low-temperature properties, through isomerization or cracking reactions. Therefore, catalytic dewaxing makes it possible to realize excellent low-temperature properties, thus desirably satisfying the pour point requirement of the lubricating base oil. According to an embodiment of the present disclosure, the catalytic dewaxing (CDW) process may be performed at a reaction temperature of 250 to 410° C., a reaction pressure of 30 to 200 kg/cm$^2$, a liquid hourly space velocity (LHSV) of 0.1 to 3.0 hr$^{-1}$, and a hydrogen-to-feedstock volume ratio of 150 to 1000 Nm$^3$/m$^3$.

The catalyst usable in the catalytic dewaxing process may include a carrier having an acid site selected from among a molecular sieve, alumina and silica-alumina, and at least one metal having a hydrogenation function selected from among elements in Groups 2, 6, 9 and 10 of the periodic table. In particular, among Group 9 and 10 (i.e. Group VIII) metals, Co, Ni, Pt and Pd are preferably used, and among Group 6 (i.e. Group VIB) metals, Mo and W are preferably used. Examples of the carrier having an acid site may include a molecular sieve, alumina, silica-alumina, etc. Here, the molecular sieve may be crystalline aluminosilicate (zeolite), SAPO, or ALPO, etc., and a medium-pore molecular sieve having a 10-membered oxygen ring such as SAPO-11, SAPO-41, ZSM-11, ZSM-22, ZSM-23, ZSM-35, ZSM-48, etc., and a large-pore molecular sieve having a 12-membered oxygen ring may be used.

In the present disclosure, the dewaxed oil fraction (i.e. the diesel fraction) may be further introduced to a hydrofinishing (HDF) unit in the presence of a hydrofinishing catalyst. Hydrofinishing (HDF) is a process of removing olefins and polycyclic aromatics from the dewaxed oil fraction in accordance with product-specific requirements in the presence of a hydrofinishing catalyst to thereby attain stability. In particular, from the viewpoint of production of naphthenic lubricating base oil, it is a process for final control of aromatic content and gas hygroscopicity. According to an embodiment of the present disclosure, the hydrofinishing (HDF) process may be performed at a temperature of 150 to 300° C., a pressure of 30 to 200 kg/cm$^2$, an LHSV of 0.1 to 3 hr$^{-1}$, and a hydrogen-to-oil volume ratio of 300 to 1500 Nm$^3$/m$^3$.

Also, the catalyst used in the hydrofinishing process is used in the form in which a metal is supported on a carrier, and the metal includes at least one metal selected from among Group 6, 8, 9, 10, and 11 elements having a hydrogenation function. Preferably, a metal sulfide series of Ni—Mo, Co—Mo or Ni—W or a noble metal such as Pt or Pd may be used. Moreover, as the carrier of the catalyst used in the hydrofinishing process, silica, alumina, silica-alumina, titania, zirconia, or zeolite, having a large surface area, may be used, and preferably alumina or silica-alumina is used.

Thereafter, the lubricating base oil of interest, having desirable low-temperature performance, may be recovered from the reaction product.

Lubricating Base Oil

The present disclosure provides a lubricating base oil having improved low-temperature performance produced from a feedstock including a diesel fraction as described above. The properties of the lubricating base oil are described below.

According to an embodiment of the present disclosure, the lubricating base oil may have kinematic viscosity at 40° C. of 9.0 cSt or less, preferably 8.0 cSt or less, and more preferably 7.0 cSt or less. The lubricating base oil may have kinematic viscosity at 100° C. of 2.5 cSt or less, preferably 2.3 cSt or less, and more preferably 2.0 cSt or less. Also, the lubricating base oil may have a pour point of −50° C. or less, particularly less than −50° C., preferably −55° C. or less, and more preferably −60° C. or less. Regarding the low-temperature performance of the lubricating base oil, the kinematic viscosity and pour point are properties that are typically used to judge low-temperature performance. The viscosity required of the lubricating base oil may differ depending on the purpose of the lubricating base oil, but the kinematic viscosity of the fluid increases with a decrease in temperature, and thus, in the present disclosure for the purpose of improving low-temperature performance, the lower the kinematic viscosity of the lubricating base oil, the better the low-temperature performance. Moreover, the lower the pour point of the lubricating base oil, the more applicable it is to low-temperature environments. The lubricating base oil according to the present disclosure has the advantage of being applicable to lubricant products that require superior low-temperature performance or to use in polar regions.

According to an embodiment of the present disclosure, the lubricating base oil may have an average carbon number of 10 to 25, preferably 10 to 22, and more preferably 10 to 20 per hydrocarbon molecule in the lubricating base oil. If the average number of carbon atoms is less than 10, a problem may occur in which the flash point and evaporation loss are too low. On the other hand, if the average number of carbon atoms exceeds 25, low-temperature viscosity and pour point become too high, which may cause a problem in that it is difficult to satisfy the performance requirements of the lubricant itself.

According to an embodiment of the present disclosure, the amount of a hydrocarbon molecule having 10 or fewer carbon atoms in the lubricating base oil may be 25 wt % or less, preferably 22 wt % or less, and more preferably 20 wt % or less, based on the total weight of the lubricating base oil. If the amount of the hydrocarbon molecule having 10 or fewer carbon atoms in the lubricating base oil is greater than 25 wt % based on the total weight of the lubricating base oil, the flash point may decrease, and thus high-temperature stability may be deteriorated, and moreover, evaporation loss may increase, which may shorten the lubricant replacement cycle.

According to an embodiment of the present disclosure, the lubricating base oil may include a naphthenic hydrocarbon in an amount of 10 to 50 wt %, preferably 15 to 50 wt %, and more preferably 20 to 50 wt %. If the amount of the naphthenic hydrocarbon is less than 10 wt %, the aniline point may increase, so compatibility with additives may decrease when manufacturing lubricant products, and the flash point may decrease. In particular, the case in which the amount of the naphthenic hydrocarbon is 20 wt % or more is preferable from the viewpoint of achieving the aniline point of the lubricating base oil at 100° C. or less. On the other hand, if the amount of the naphthenic hydrocarbon exceeds 50 wt %, oxidation stability and thermal stability may decrease.

As for the lubricating base oil of the present disclosure, the amount of each type of hydrocarbon in the lubricating base oil has a significant effect on the properties of the lubricating base oil. More specifically, when the amount of the paraffinic hydrocarbon in the lubricating base oil increases, lubrication performance may increase, oxidation stability and thermal stability may be improved, and the ability to maintain viscosity depending on changes in temperature is improved, but flowability at low temperatures is decreased. Also, when the amount of the aromatic hydrocarbon in the lubricating base oil increases, compatibility with additives may be improved, but oxidation stability and thermal stability may be deteriorated and hazard may increase. Also, when the amount of the naphthenic hydrocarbon in the lubricating base oil increases, compatibility with additives and flowability at low temperatures may be improved, but oxidation stability and thermal stability may be deteriorated. Meanwhile, in the present disclosure, the amount of each type of hydrocarbon in the lubricating base oil is measured through the composition analysis method specified in ASTM D2140 or ASTM 3238.

The inventors of the present disclosure have found that the properties of the lubricating base oil of the present disclosure are affected by the following relationships. According to an embodiment of the present disclosure, the lubricating base oil may satisfy $0.3 \leq (C_N+C_A)/C_P \leq 0.7$. Here, $C_N$ is the wt % of the naphthenic hydrocarbon, $C_A$ is the wt % of the aromatic hydrocarbon, and $C_P$ is the wt % of the paraffinic hydrocarbon. If the value of $(C_N+C_A)/C_P$ is less than 0.3, it is difficult to achieve the desired low pour point of the lubricating base oil and/or it is difficult to achieve an aniline point of 100° C. or less. On the other hand, if the value of $(C_N+C_A)/C_P$ exceeds 0.7, it is difficult to achieve the desired low-temperature viscosity of the lubricating base oil.

According to another embodiment of the present disclosure, the lubricating base oil may satisfy 25 wt $\% \leq C_n + C_a \leq 45$ wt %. Likewise, if the value of $(C_n+C_a)$ is less than 25 wt %, it is difficult to achieve the desired low pour point of the lubricating base oil and/or it is difficult to achieve an aniline point of 100° C. or less. On the other hand, if the value of $(C_n+C_a)$ exceeds 45 wt %, it is difficult to achieve the desired low-temperature viscosity of the lubricating base oil.

According to an embodiment of the present disclosure, the lubricating base oil may have a low-temperature viscosity of 550 cSt or less, preferably 520 cSt or less, and more preferably 500 cSt or less when measured at −40° C. If the kinematic viscosity of the lubricating base oil exceeds 550 cSt at −40° C., the kinematic viscosity is so high that it is difficult to function as a lubricating base oil in very cold environments.

According to an embodiment of the present disclosure, the lubricating base oil may have a flash point of 110° C. or more, evaporation loss at 150° C. of 20 wt % or less, and a 5% outflow temperature of 200° C. or more in a simulated distillation test according to ASTM D2887. Preferably, the lubricating base oil has a flash point of 120° C. or more, evaporation loss at 150° C. of 18 wt % or less, and a 5% outflow temperature of 220° C. or more in a simulated distillation test according to ASTM D2887. In order to serve in various fields, lubricants must have resistance to heat that may occur in the respective fields. For example, a lubricant having a specific flash point may ignite at a temperature higher than the above flash point, and therefore cannot be applied as a lubricant in an environment in which temperatures higher than the above flash point are required. Moreover, the low evaporation of the lubricating base oil reduces the consumption of oil and increases the durability of oil, and is thus regarded as important in the manufacture of a low-viscosity lubricant. If the 5% outflow temperature in a simulated distillation test is lower than 200° C., a problem in which the flash point and evaporation loss performance of the lubricating base oil are not satisfied may occur. In the present disclosure, the flash point of the lubricating base oil is measured through the ASTM D92-COC method. Also, the evaporation loss is measured at a temperature of 150° C., rather than 250° C., in the ASTM D5800 test.

Lubricant Product

The present disclosure provides a lubricant product including a mineral oil-based lubricating base oil having improved low-temperature performance. As the lubricating base oil having improved low-temperature performance, the aforementioned lubricating base oil is used.

In an embodiment of the present disclosure, the lubricant product may include 20 to 99 wt % of the lubricating base oil according to the present disclosure. The amount of the lubricating base oil according to the present disclosure may be variously adjusted depending on the end use and purpose of the lubricant product, and the lubricating base oil according to the present disclosure may be used in appropriate combinations with other mineral oil-based lubricating base oil products so as to be adapted for desired product specifications.

The lubricant product may have a pour point of −40° C. or less, preferably −45° C. or less, and more preferably −50° C. or less.

In an embodiment of the present disclosure, the lubricant product does not contain synthetic base oil. For example, the lubricant product does not contain PAO or ester base oil. The use of the lubricating base oil according to the present disclosure, rather than expensive PAO or ester base oil, makes it possible to manufacture lubricant products having superior low-temperature performance.

In an embodiment of the present disclosure, the lubricant product may further include additives. The additive may be, for example, an antioxidant, a rust inhibitor, a clean dispersant, an antifoaming agent, a viscosity improver, a viscosity index improver, an extreme pressure agent, a pour point depressant, a corrosion inhibitor, or an emulsifier. However, the additive is not limited thereto, so long as it is generally added to lubricant products.

The lubricant product may be used in fields or environments in which low-temperature performance is required, and it is possible to replace lubricant products manufactured from conventional PAOs or ester base oils. The lubricant product may be, for example, shock absorber oil for automobiles, hydraulic oil for use in polar regions, electrical insulating oil, etc., but is not limited thereto.

In addition, in an embodiment according to the present disclosure, the lubricant product is applicable as white oil for use in the lubrication of plastics, polishes, the paper industry, textile lubricants, pesticide base oils, pharmaceutical compositions, cosmetics, food and food-processing machinery, etc.

A better understanding of the present disclosure will be given through the following examples, which are not to be construed as limiting the scope of the present disclosure.

Examples

1. Production of Lubricating Base Oil (Base Oil A)

A feedstock including a diesel fraction was obtained by subjecting a product of a fuel-oil hydrogenation process using vacuum gas oil (VGO) to fractional distillation. The properties of the feedstock thus obtained are shown in Table 3 below, and the numerical values of the properties were measured according to ASTM methods.

TABLE 3

| Items | Method | Data |
|---|---|---|
| API Gravity | D1298 | 36.5 |
| Specific gravity (60/60° F.) | D1298 | 0.8423 |
| Kinematic viscosity @40° C., cSt | D445 | 4.494 |
| Kinematic viscosity @100° C., cSt | D445 | 1.58 |
| Pour point, ° C. | D97 | −15 |
| Sulfur content, ppm | D5453 | 1.3 |
| Nitrogen content, ppm | D4629 | 1.0 |

The feedstock obtained above was fed to a catalytic dewaxing unit, and the product of the catalytic dewaxing was fed to a hydrofinishing unit. The processing conditions of the catalytic dewaxing unit and the processing conditions of the hydrofinishing unit are shown in Table 4 below. Thereafter, the product of the hydrofinishing unit was recovered as lubricating base oil.

TABLE 4

| Catalyst | CDW<br>HDF | Pt-based catalyst<br>Pt-based catalyst |
|---|---|---|
| LHSV | $hr^{-1}$ | 1.4 |
| $H_2$/Oil ratio | $Nm^3/Sm^3$ | 500 |
| $H_2$ flow rate | NL/hr | 280 |
| Feed speed | cc/hr | 560 |
| Pressure | $Kg/cm^2g$ | 150 |
| Reaction temperature (CDW/HDF) | ° C. | 330/230 |

2. Analysis of Properties and Composition of Produced Lubricating Base Oil

The composition and properties of the produced lubricating base oil were analyzed. The composition and properties thereof are shown in Tables 5 and 6 below.

TABLE 5

| | |
|---|---|
| Paraffinic hydrocarbon content ($C_P$), wt % | 61.6 |
| Naphthenic hydrocarbon content ($C_N$), wt % | 37.5 |
| Aromatic hydrocarbon content ($C_A$), wt % | 0.9 |
| $(C_N + C_A)/C_P$ | 0.59 |
| $C_N + C_A$ | 38.4 |

The amount of each type of hydrocarbon in the lubricating base oil was measured according to the ASTM D2140 test method. As shown in Table 5, the base oil A satisfied $(C_N+C_A)/C_P$ in the range of 0.3 to 0.7 and $C_N+C_A$ in the range of 25 wt % to 45 wt %.

TABLE 6

| Items | Base oil A |
|---|---|
| Kinematic viscosity @40° C., cSt | 4.934 |
| Kinematic viscosity @100° C., cSt | 1.662 |
| D5%, D2887, ° C. | 222 |
| Flash point, ° C. | 130 |
| Evaporation loss (@150° C., wt %) | 17.4 |
| Pour point, ° C. | −69 |

As shown in Table 6, the lubricating base oil of the present disclosure was mineral oil-based lubricating base oil, rather than synthetic base oil, but exhibited low kinematic viscosity and superior low-temperature performance even without the use of an additional additive. Conventionally, as described above, PAO is mainly used as a lubricating base oil in fields requiring low-temperature performance. Accordingly, the use of the lubricating base oil of the present disclosure as a substitute for PAO is an important purpose of the present disclosure. The properties of the lubricating base oil (base oil A) according to the present disclosure and the properties of PAO are compared in Table 7 below.

TABLE 7

| Items | PAO | Base oil A |
|---|---|---|
| Specific gravity (15/4° C.) | 0.7982 | 0.8383 |
| Kinematic viscosity @40° C., cSt | 5.111 | 4.934 |
| Kinematic viscosity @100° C., cSt | 1.709 | 1.662 |
| Pour point, ° C. | <−50 | <−50 |
| Aniline point, ° C. | 102.3 | 88.4 |
| Naphthenic hydrocarbon, wt % | <1 | 38 |

As shown in Table 7, the lubricating base oil (base oil A) of the present disclosure exhibited kinematic viscosity and a pour point superior or similar to those of PAO.

3. Evaluation of Performance of Lubricant Product

In order to evaluate the low-temperature performance of the lubricating base oil according to the present disclosure when used in the manufacture of a lubricant product, a lubricant product including the lubricating base oil (base oil A) having the composition of Table 5 and the properties of Table 6 was manufactured, and the performance thereof was evaluated.

(1) Shock Absorber Oil for Automobiles

A lubricant product for use in shock absorbers for automobiles was manufactured using to base oil A. The composition of the product is shown in Table 8 below.

TABLE 8

| Composition | Amount (wt %) |
|---|---|
| Base oil A | 90.0 |
| Viscosity index improver (VII) | 8.7 |
| Friction Modifier (FM) | 1.0 |
| Antioxidant (AO) | 0.3 |
| Total | 100.0 |

Also, the properties of the shock absorber oil are shown in Table 9 below.

TABLE 9

| Test items | Shock absorber oil |
|---|---|
| Kinematic viscosity, cSt (@40° C.) | 11.75 |
| Kinematic viscosity, cSt (@100° C.) | 4.451 |
| Viscosity index | 364 |
| Brookfield viscosity, cP (@−40° C.) | 498 |
| Pour point, ° C. | <−50 |
| Evaporation loss, wt % (ASTM D5800 @150° C.) | 15.2 |

As shown in Table 9, it can be confirmed that the use of the lubricating base oil (base oil A) according to the present disclosure makes it possible to manufacture a shock absorber oil having excellent performance without using PAO.

(2) Hydraulic Oil ISO VG 32 for Use in Polar Regions

Hydraulic oil for use in polar regions, corresponding to ISO VG 32, was manufactured by mixing base oil A and Group III base oil, that is, base oil B, available from SK Lubricants. The properties of the base oil B are shown in Table 10 below.

TABLE 10

| Items | ASTM Method | Data |
|---|---|---|
| Specific gravity (15/4° C.) | D1298 | 0.8324 |
| Kinematic viscosity, cSt (@40° C.) | D445 | 12.73 |
| Kinematic viscosity, cSt (@100° C.) | D445 | 3.12 |
| Viscosity index | D2270 | 105 |
| Pour point, ° C. | D97 | −45 |

Also, the composition of the hydraulic oil for use in polar regions is shown in Table 11 below.

TABLE 11

| Composition | Amount (wt %) |
|---|---|
| Base oil A | 37.78 |
| Base oil B | 43.00 |
| Viscosity index improver (VII) | 18.00 |
| Pour point depressant (PPD) | 0.30 |
| Anti-foamer (AF) | 0.05 |
| Ashless Antiwear agent (AW) | 0.87 |
| Total | 100.0 |

Also, the properties of the hydraulic oil for use in polar regions are shown in Table 12 below.

TABLE 12

| Test items | Hydraulic oil |
|---|---|
| Kinematic viscosity, cSt (@40° C.) | 30.24 |
| Kinematic viscosity, cSt (@100° C.) | 9.825 |
| Viscosity index | 337 |
| Brookfield viscosity, cP (@−40° C.) | 2130 |
| Pour point, ° C. | −63 |

As shown in Table 12, the hydraulic oil composed of base oil A and base oil B had low Brookfield viscosity at −40° C. and also a low pour point, and is thus regarded as a product having excellent low-temperature performance. Thereby, it can be found that it is possible to design a mineral oil-based lubricant product having excellent low-temperature performance without using PAO.

(3) Hydraulic Oil ISO VG 15 for Use in Polar Regions

Hydraulic oil for use in polar regions, corresponding to ISO VG 15, was manufactured to using base oil A. The composition of the hydraulic oil for use in polar regions is shown in Table 13 below.

TABLE 13

| Composition | Amount (wt %) |
|---|---|
| Base oil A | 86 |
| Viscosity index improver | 13 |
| Other additives | 1 |
| Total | 100 |

Also, the properties of the hydraulic oil for use in polar regions are shown in Table 14 below.

TABLE 14

| Test items | Hydraulic oil |
|---|---|
| Kinematic viscosity, cSt (@40° C.) | 14.21 |
| Kinematic viscosity, cSt (@100° C.) | 5.321 |
| Viscosity index | 381 |
| Brookfield viscosity, cP (@−40° C.) | <500 |
| Pour point, ° C. | −72 |

As shown in Table 14, the hydraulic oil manufactured using base oil A had low Brookfield viscosity at −40° C. and also a low pour point, and is thus regarded as a product having excellent low-temperature performance.

(4) Electrical Insulating Oil

Electrical insulating oil was manufactured by mixing base oil A and Group III base oil, that is, base oil C, available from SK Lubricants. The properties of the base oil C are shown in Table 15 below.

TABLE 15

| Items | ASTM Method | Data |
|---|---|---|
| Specific gravity (@15/4° C.) | D1298 | 0.8299 |
| Kinematic viscosity, cSt (@40° C.) | D445 | 12.43 |
| Kinematic viscosity, cSt (@100° C.) | D445 | 3.12 |
| Viscosity index | D2270 | 112 |
| Pour point, ° C. | D97 | −24 |

The properties of the electrical insulating oil were tested by varying the amounts of the above two types of base oil. The test results are summarized in Table 16 below.

TABLE 16

| Composition | Specification | | Test results | | |
|---|---|---|---|---|---|
| Base oil A | ASTM | IEC | 20 | 25 | 30 |
| Base oil C | D3487 | 60296 | 80 | 75 | 70 |
| Kinematic viscosity, cSt (@40° C.) | ≤12.0 | ≤12.0 | 9.89 | 9.45 | 9.034 |
| Pour point, ° C. | ≤−40 | ≤−40 | −42 | −42 | −45 |
| Flash point (COC), ° C. | ≥145 | | 170 | 158 | 152 |
| Flash point (PMCC), ° C. | | ≥135 | 150 | 142 | 138 |

As shown in Table 16, as the amount of base oil A increased, the flash point decreased, but the viscosity and the pour point further improved. Based on the above results, it can be found that it is possible to design electrical insulating oil that satisfies ISO standards by appropriately mixing the base oil A with another mineral oil-based lubricating base oil.

(5) Applicability to White Oil

Whether the base oil A is usable as food-grade white oil was evaluated through experiments.

1) UV Absorbance Measurement

In order to confirm that it satisfies the criteria for food-grade white oil prescribed by the US Food and Drug Administration (FDA), UV absorbance was measured in a wavelength range of 260-350 nm by directly radiating light onto the base oil A. The measurement results are shown in FIG. 1.

Based on the experimental results, the UV absorbance of base oil A in the above wavelength range was determined to be less than 0.1. The maximum UV absorbance of food-grade white oil prescribed by the US Food and Drug Administration (FDA) is 0.1, which indicates the value of UV absorbance determined through the DMSO extraction method according to the IP 346 method. The UV absorbance value determined through DMSO extraction is generally known to be lower than the absorbance value measured by directly radiating light onto a sample. Thus, as for the base oil A of the present disclosure, since the absorbance value measured by directly radiating light thereon is 0.1 or less, it is obvious that it will have a lower absorbance value when measuring UV absorbance through the DMSO extraction method. Therefore, it can be found that the base oil A of the present disclosure satisfies food-grade requirements.

2) Sulfuric Acid Coloration Test

In order to confirm whether the amount of impurities contained in the base oil A falls within a range usable as white oil, a qualitative experiment was conducted using sulfuric acid. The sulfuric acid coloration test was performed based on the test method specified in ASTM D565. The results of the sulfuric acid coloration test are shown in FIG. 2.

Figure 2:
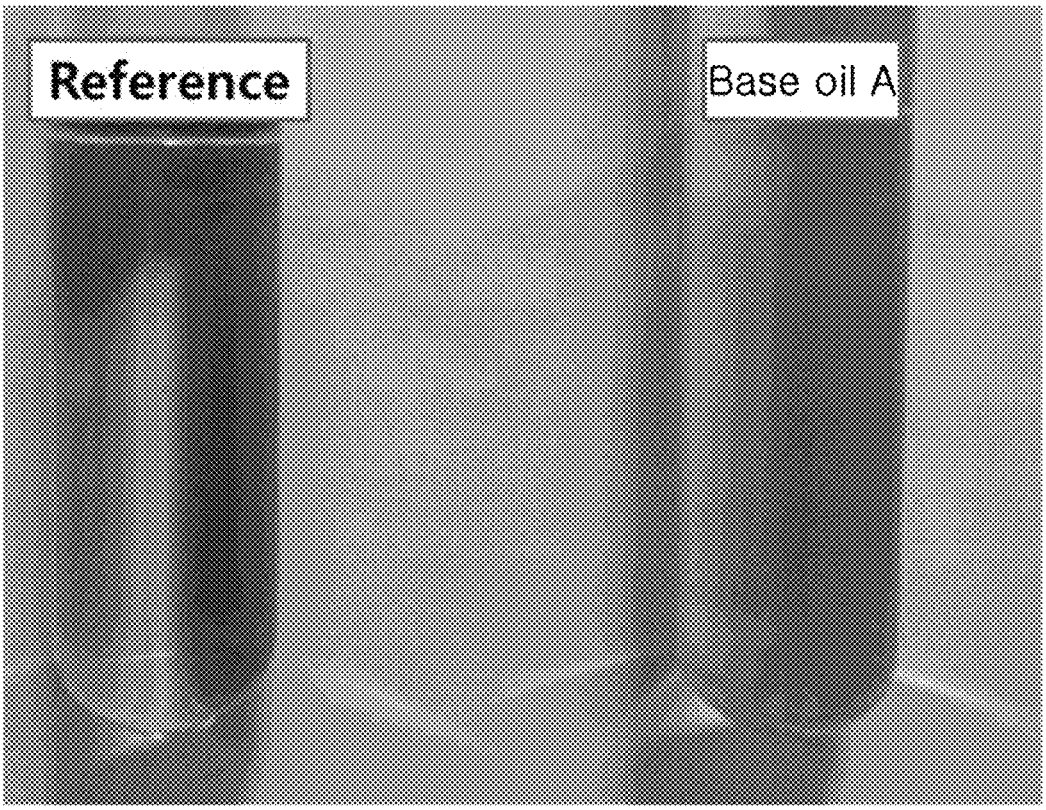
FIG. 2 shows the results of a sulfuric acid coloration test of the lubricating base oil according to an embodiment of the present disclosure.

As shown in FIG. 2, the extent of discoloration of base oil A was confirmed to be less than that of the reference. Therefore, it can be found that the amount of impurities in the base oil A falls within a range within which use thereof as white oil is permitted.

Through the UV absorbance measurement and the sulfuric acid coloration test, it can be concluded that base oil A can be used as food-grade white oil.

Simple modifications or variations of the present disclosure fall within the scope of the present disclosure as defined in the accompanying claims.

What is claimed is:

1. A method of producing a lubricating base oil, comprising:

providing a feedstock comprising a diesel fraction;

subjecting the feedstock to catalytic dewaxing; and recovering a lubricating base oil from a product of the catalytic dewaxing, wherein the feedstock has a specific gravity of 0.81 to 0.87, a kinematic viscosity at 40° C. of 5.0 cSt or less, a kinematic viscosity at 100° C. of 2.0 cSt or less, and a pour point of 5° C. or less, and contains 2.0 wt % or less of each of sulfur and nitrogen.

2. The method of claim 1, wherein the feedstock has a 10% outflow temperature of 250° C. or less and a 50% outflow temperature of 350° C. or less in a simulated distillation test according to ASTM D2887.

3. The method of claim 1, wherein an average carbon number of a hydrocarbon molecule in the feedstock is 10 to 25.

4. The method of claim 1, wherein the feedstock comprises 90 wt % or more of the diesel fraction.

5. The method of claim 1, wherein the feedstock further comprises a fuel oil fraction that is lighter than the diesel fraction.

6. The method of claim 5, wherein the fuel oil fraction that is lighter than the diesel fraction is a kerosene fraction.

7. The method of claim 1, wherein the feedstock comprises unconverted oil in an amount less than 5 wt %.

8. The method of claim 1, wherein the catalytic dewaxing is performed at a reaction temperature of 250 to 410° C., a reaction pressure of 30 to 200 $kg/cm^2$, a liquid hourly space velocity (LHSV) of 0.1 to 3.0 $hr^{-1}$, and a hydrogen-to-feedstock volume ratio of 150 to 1000 $Nm^3/m^3$.

9. A lubricating base oil produced by the method of claim 1, wherein the lubricating base oil has a kinematic viscosity at 40° C. of 9.0 cSt or less, a kinematic viscosity at 100° C. of 2.5 cSt or less, and a pour point of −50° C. or less.

* * * * *